US009332795B1

(12) United States Patent
Jung

(10) Patent No.: US 9,332,795 B1
(45) Date of Patent: May 10, 2016

(54) NECK SUPPORT APPARATUS AND APPLICATIONS THEREOF

(71) Applicant: Ji Hyuk Rick Jung, Alpharetta, GA (US)

(72) Inventor: Ji Hyuk Rick Jung, Alpharetta, GA (US)

( * ) Notice: Subject to any disclaimer, the term of this patent is extended or adjusted under 35 U.S.C. 154(b) by 0 days.

(21) Appl. No.: 13/861,996

(22) Filed: Apr. 12, 2013

Related U.S. Application Data

(60) Provisional application No. 61/623,873, filed on Apr. 13, 2012.

(51) Int. Cl.
*A41D 13/05* (2006.01)

(52) U.S. Cl.
CPC ..... *A41D 13/0512* (2013.01)

(58) Field of Classification Search
CPC . A41D 13/0512; A63B 71/1291; A63B 71/12
USPC ..... 2/468, 455, 410, 425
See application file for complete search history.

(56) References Cited

U.S. PATENT DOCUMENTS

| | | | | | |
|---|---|---|---|---|---|
| 2,741,767 | A * | 4/1956 | Weeks | 2/462 |
| 3,189,917 | A * | 6/1965 | Sims | 2/415 |
| 3,497,872 | A * | 3/1970 | Mitchell | 2/468 |
| 3,514,784 | A * | 6/1970 | McDavid | 2/468 |
| 3,657,739 | A * | 4/1972 | Holmes, Sr. | 2/468 |
| 3,855,631 | A * | 12/1974 | Ettinger | 2/468 |
| 4,135,252 | A * | 1/1979 | Latina et al. | 2/462 |
| 4,322,859 | A * | 4/1982 | Mitchell | 2/462 |
| 4,338,685 | A * | 7/1982 | LaPorta, Jr. | 2/462 |
| 4,425,667 | A * | 1/1984 | Harrison | 2/462 |
| 4,501,023 | A * | 2/1985 | Bilberry | 2/462 |
| 4,590,622 | A * | 5/1986 | Wolfe et al. | 2/462 |
| 4,638,510 | A * | 1/1987 | Hubbard | 2/6.1 |
| 4,757,554 | A * | 7/1988 | Blair | 2/468 |
| 4,821,339 | A * | 4/1989 | Fair | 2/462 |
| 4,870,705 | A * | 10/1989 | Higby et al. | 2/468 |
| 4,881,529 | A * | 11/1989 | Santos | 2/468 |
| 4,989,265 | A * | 2/1991 | Nipper et al. | 2/462 |
| 4,996,720 | A * | 3/1991 | Fair | 2/462 |
| 5,133,084 | A * | 7/1992 | Martin | 2/468 |
| 5,404,590 | A * | 4/1995 | Monica, Jr. | 2/468 |
| 5,483,698 | A * | 1/1996 | Douglas, Jr. | 2/462 |
| 5,546,601 | A * | 8/1996 | Abeyta | 2/468 |
| 5,551,081 | A * | 9/1996 | Starnes et al. | 2/468 |
| 6,058,517 | A * | 5/2000 | Hartunian | 2/468 |
| 6,067,665 | A * | 5/2000 | DePalma et al. | 2/468 |
| 6,308,345 | B1 * | 10/2001 | Williams, Jr. | 2/468 |
| 6,457,195 | B1 * | 10/2002 | Holste | 5/636 |
| 6,874,170 | B1 * | 4/2005 | Aaron | 2/468 |

(Continued)

*Primary Examiner* — Danny Worrell
(74) *Attorney, Agent, or Firm* — Smith Moore Leatherwood LLP; J. Clinton Wimbish

(57) ABSTRACT

In one aspect, neck support apparatus are described herein. In some embodiments, a neck support apparatus comprises a band comprising a first end, a second end and a neck support region positioned between the first end and the second end, the first end comprising a first fastener and the second end comprising a second fastener, wherein the neck support region has one or more dimensions sufficient to restrain, prevent, or inhibit neck extension beyond a 70 degree angle when the band is placed in tension by coupling the first and second ends to body equipment on the torso of an individual, the angle defined by the intersection of a line drawn from the tragus of the ear to the canthus of the eye and a horizontal line of the tragus.

19 Claims, 12 Drawing Sheets

(56) References Cited

U.S. PATENT DOCUMENTS 7,017,194 B2 * 3/2006 Schroth ..... 2/410
7,841,344 B2 * 11/2010 Schlosser ..... 128/205.22
7,861,326 B2 * 1/2011 Harty ..... 2/468
7,865,987 B2 * 1/2011 Deetsch ..... 5/640
8,615,819 B2 * 12/2013 Kerr ..... 2/468
2014/0020163 A1 * 1/2014 Stiles et al. ..... 2/468

* cited by examiner

NECK SUPPORT APPARATUS AND APPLICATIONS THEREOF

CROSS REFERENCE TO RELATED APPLICATION

This application claims priority pursuant to 35 U.S.C. §119 (e) to U.S. Provisional Patent Application Ser. No. 61/623,873 filed on Apr. 13, 2012, which is hereby incorporated by reference in its entirety.

FIELD

The present invention relates to apparatus and methods for supporting parts of the human body and, in particular, to apparatus and methods for supporting the neck.

BACKGROUND

Incorrect head posture has been linked to a variety of ailments, including systemic neck pain. Further, neck pain can be associated with additional symptoms such as headaches, facial pain, shoulder pain and arm numbness or tingling.

Existing apparatus for supporting the neck in efforts to alleviate neck pain or discomfort suffer from a variety of disadvantages. For example, collars and braces encircling the neck of a user are bulky and restrictive to wear. Moreover, such devices cannot be used by athletes or other individuals involved in contact applications at risk of having the device pulled upon. Additionally, apparatus such as neck pillows provide insufficient neck support and lack the ability to restrict neck extension.

SUMMARY

In one aspect, neck support apparatus are described herein. In some embodiments, a neck support apparatus comprises a band comprising a first end, a second end and a neck support region positioned between the first end and the second end, the first end comprising a first fastener and the second end comprising a second fastener, wherein the neck support region has one or more dimensions sufficient to restrain, prevent or inhibit neck extension beyond a 70 degree angle when the band is placed in tension by coupling the first and second ends to an article on the torso or waist of an individual, the angle defined by the intersection of a line drawn from the tragus of the ear to the canthus of the eye and a horizontal line of the tragus.

Alternatively, in other embodiments, the neck support region of a neck support apparatus described herein does not necessarily have one or more dimensions sufficient to restrain, prevent or inhibit neck extension. In some embodiments, a neck support apparatus comprises a band comprising a first end, a second end and a neck support region positioned between the first end and the second end, the first end comprising a first fastener coupled to body equipment on the torso or waist of an individual and the second end comprising a second fastener coupled to the body equipment on the torso or waist of the individual.

Moreover, in some embodiments described herein, the band of a neck support apparatus partially encircles the neck of the individual.

In another aspect, methods of supporting an individual's neck are described herein. In some embodiments, a method of supporting an individual's neck comprises providing a primary band comprising a first end, a second end and a neck support region positioned between the first end and the second end; positioning the neck support region adjacent to the neck of the individual; and placing the band in tension by coupling the first end and the second end to an article on the torso or waist of the individual, wherein the neck support region has one or more dimensions sufficient to restrain, prevent or inhibit neck extension beyond a 70 degree angle defined by the intersection of a line drawn from the tragus of the ear to the canthus of the eye and a horizontal line of the tragus. In some embodiments, a method further comprises altering the angle by adjusting the tension of the band. For example, in some embodiments, the angle is increased by reducing the tension of the band. In other embodiments, the angle is decreased by increasing the tension of the band.

In some embodiments, a method of supporting an individual's neck comprises providing a primary band comprising a first end, a second end and a neck support region positioned between the first end and the second end; positioning the neck support region adjacent to the neck of the individual; and placing the band in tension by coupling the first end and the second end to body equipment on the torso or waist of the individual.

These and other embodiments are described in greater detail in the detailed description which follows.

DETAILED DESCRIPTION

Figure 1:
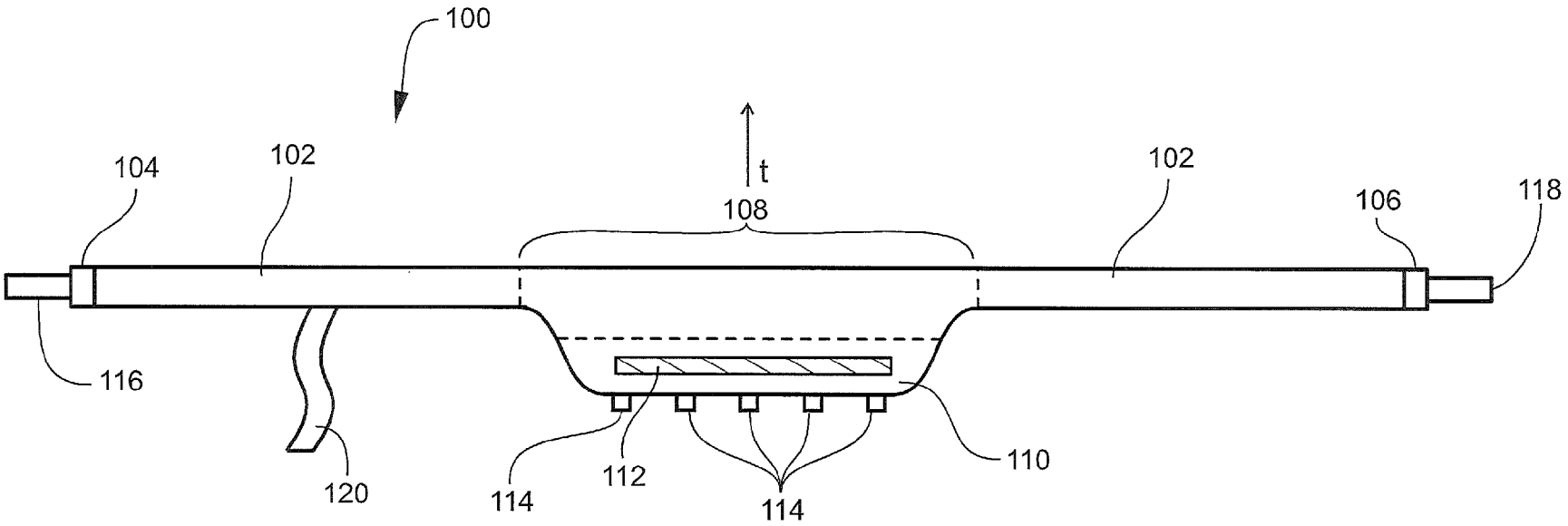
FIG. 1 illustrates a top view of a band of a neck support apparatus according to one embodiment described herein.

Embodiments described herein can be understood more readily by reference to the following detailed description and drawings. Elements, apparatus and methods described herein, however, are not limited to the specific embodiments presented in the detailed description and drawings. It should be recognized that these embodiments are merely illustrative of the principles of the present invention. Numerous modifications and adaptations will be readily apparent to those of skill in the art without departing from the spirit and scope of the invention.

In addition, all ranges disclosed herein are to be understood to encompass any and all subranges subsumed therein. For example, a stated range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

I. Neck Support Apparatus

In one aspect, neck support apparatus are described herein. In some embodiments, a neck support apparatus comprises a band comprising a first end, a second end and a neck support region positioned between the first end and the second end, the first end comprising a first fastener and the second end comprising a second fastener, wherein the neck support region has one or more dimensions sufficient to restrain neck extension beyond a 70 degree angle when the band is placed in tension by coupling the first and second ends to an article on the torso or waist of an individual, the angle defined by the intersection of a line drawn from the tragus of the ear to the canthus of the eye and a horizontal line of the tragus. The angle, in some embodiments, is in the sagittal plane. Moreover, in some embodiments, the neck support region has one or more dimensions sufficient to prevent neck extension beyond a 60 degree angle or a 50 degree angle when the band is placed in tension as described herein. In some embodiments, the neck support region has one or more dimensions sufficient to inhibit neck extension beyond an angle of about 45 degrees or about 35 degrees. In some embodiments, the neck support region has one or more dimensions sufficient to restrain, prevent or inhibit neck extension beyond an angle of about 25 degrees or about 20 degrees. In some embodiments, the neck support region has one or more dimension sufficient to restrain neck extension beyond an angle of about 15 degrees.

In some embodiments, the one or more dimensions of the neck support region are operable to restrain, prevent or inhibit neck extension beyond any of the angles described herein when the neck is in a state or rest. Alternatively, in other embodiments, the one or more dimensions of the neck support region are operable to restrain, prevent or inhibit neck extension beyond any of the angles described herein when the neck is actively extended against the neck support region.

Dimension(s) of the neck support region sufficient to restrain, prevent or inhibit neck extension beyond any of the angles described herein, in some embodiments, include thickness and/or height of the neck support region. In some embodiments, for example, the neck support region comprises a thickness sufficient to restrain, prevent or inhibit neck extension beyond any of the angles described herein. In some embodiments, the neck support region comprises a height sufficient to restrain, prevent or inhibit neck extension beyond any of the angles described herein. The neck support region, in some embodiments, comprises a thickness and height sufficient to restrain, prevent or inhibit neck extension beyond any of the angles described herein.

Alternatively, in other embodiments, the neck support region of a neck support apparatus described herein does not necessarily have one or more dimensions sufficient to restrain, prevent or inhibit neck extension as described herein. In some embodiments, a neck support apparatus comprises a band comprising a first end, a second end and a neck support region positioned between the first end and the second end, the first end comprising a first fastener coupled to body equipment on the torso or waist of an individual and the second end comprising a second fastener coupled to the body equipment on the torso or waist of the individual. In some embodiments, a neck support apparatus coupled to body equipment on the torso or waist of an individual is operable to provide neck support to the individual without the need for the neck support region to have one or more dimensions sufficient to restrain, prevent or inhibit neck extension as described herein.

Moreover, in some embodiments, a neck support apparatus described herein does not enclose the neck of the individual. Instead, in some embodiments, a neck support apparatus described herein contacts the back and/or sides of the neck, thereby only partially encircling the neck. Further, in some embodiments, a neck support apparatus described herein is operable to support the neck by conforming to at least a portion of the surface of the neck, including the back of the neck. Moreover, tension in the band, in some embodiments, is provided by coupling the first and second ends of the neck support apparatus to an article or body equipment on the torso or waist of an individual. In addition, in some embodiments, the tension is operable to distribute force or weight to the article or body equipment on the torso or waist, including the weight of the neck support apparatus itself.

Therefore, in some embodiments, a neck support apparatus described herein is operable to support and/or reduce strain on one or more neck muscles. For example, in some embodiments, a neck support apparatus is operable to support and/or reduce strain on one or more of the levator scapulae, trapezius, semispinalis, multifidi, and splenius muscles. Semispinalis muscles, in some embodiments, comprise semispinalis dorsi, cervicis, and/or capitis muscles. Splenius muscles, in some embodiments, comprise splenius cervicis and/or capitis muscles. In some embodiments, a neck support apparatus described herein is operable to reduce the need to use one or more of the foregoing muscles.

Further, in some embodiments, a neck support apparatus described herein is operable to support the neck by providing a head rest and/or by helping the neck to support the head.

Turning now to the figures, FIG. 1 illustrates a top-down view of a band of a neck support apparatus according to one embodiment described herein. As illustrated in FIG. 1, the band (102) of the neck support apparatus (100) comprises a material having a first end (104) and a second end (106). A neck support region (108) is positioned between the first end (104) and the second end (106) of the band (102). In some embodiments, the material is a continuous piece of material. Alternatively, in other embodiments, the material is not a continuous piece of material. In one embodiment, for example, the band (102) comprises a plurality of individual pieces of material sewn together or otherwise coupled.

In addition, in some embodiments, the neck support region (108) comprises a detachable component (110) reversibly coupled to the band (102). Alternatively, in other embodiments, the neck support region (108) does not comprise a detachable component (110) reversibly coupled to the band (102). In some embodiments comprising a detachable component (110), the detachable component (110) comprises a tissue heating or cooling material (112) reversibly coupled to the band (102). The tissue heating or cooling material (112), in some embodiments, resides between the skin of the individual and the band (102). In some embodiments, the detachable component (110) comprises a packing or stuffing that does not have tissue heating or cooling operability. In some embodiments, for example, a detachable component comprises a bean-bag material or construction. In some embodiments, the detachable component (110) is coupled to the neck support region (108). Alternatively, in other embodiments, the detachable component (110) can be coupled to the band (102) in an area outside the neck support region (108). In some embodiments, for example, a tissue heating or cooling material (112) is coupled to a surface of the band (102) between the neck support region (108) and the first (104) or second (106) ends of the band (102).

Moreover, the detachable component (110) can be coupled to the neck support region (108) in any manner not inconsistent with the objectives of the present invention. In some embodiments, for instance, the detachable component (110) is coupled to the neck support region (108) of the band (102) by at least one hook and loop fastener arrangement. Hook and loop fasteners, in some embodiments, comprise VELCRO® or unbreakable loop backings (UBL). In other embodiments, the detachable component (110) is coupled to the neck support region (108) by a zipper, button, or snap arrangement. In some embodiments, the neck support region (108) comprises a pouch (not shown) in which the detachable component (110) is disposed. The walls of the pouch, in some embodiments, have a variable thickness. Pouches having walls of variable thickness, in some embodiments, can allow a user to tailor the effect of the detachable component (110), such as the amount of heating or cooling provided by a tissue heating or cooling material (112). Moreover, in some embodiments comprising a detachable component (110) comprising a tissue heating or cooling material (112) reversibly coupled to the band (102), the reversible nature of the coupling permits a used tissue heating or cooling material to be replaced by a new or fresh tissue heating or cooling material at any desired time by the individual. Further, as understood by one of ordinary skill in the art, a reversible coupling arrangement, for reference purposes herein, comprises a coupling arrangement that can be used to attach (couple) or detach (decouple) two components multiple times without damaging or substantially damaging the coupled or decoupled components, such as the detachable component (110) and the neck support region (108).

In some embodiments, the neck support region of the band without a detachable component has one or more dimensions sufficient to restrain, prevent or inhibit neck extension beyond any of the angles described herein. In some embodiments, for example, the neck support region of the band has a thickness and/or height sufficient to restrain, prevent or inhibit neck extension beyond any of the angles described herein. Alternatively, in some embodiments, the neck support region of the band in conjunction with a detachable component has one or more dimensions sufficient to restrain, prevent or inhibit neck extension beyond any of the angles described herein. In some embodiments, for example, the neck support region of the band in conjunction with a detachable component has a thickness and/or height sufficient to restrain, prevent or inhibit neck extension beyond any of the angles described herein.

Alternatively, in some embodiments wherein the neck support apparatus is coupled to body equipment at the torso or waist of an individual, the neck support region of the band does not have one or more dimensions sufficient to restrain, prevent or inhibit neck extension. In such embodiments, however, the neck support apparatus can have any other feature of neck support apparatus described herein. For example, in some embodiments, the neck support region of a neck support apparatus described herein does not have one or more dimensions sufficient to restrain, prevent or inhibit neck extension but does have a detachable component coupled to the neck support region. The neck support region, in some embodiments, comprises a tissue heating or cooling material reversibly coupled to the band of the neck support apparatus.

In addition, in the embodiment illustrated in FIG. 1, the band (102) further comprises a flange or tongue (not shown). In some embodiments, the flange extends beneath the neck support region (108) and is substantially coplanar with the neck support region (108). The flange can assist in keeping the neck support region (108) of the band (102) in the proper position when in use by an individual. In addition, in some embodiments, the flange can be inserted under the shirt or other article of clothing of an individual to assist in maintaining the proper position of the neck support region (108). The flange can have any desired shape, including a circular, semicircular, elliptical, triangular, square, rectangular, trapezoidal or any other polygonal shape.

In some embodiments, a surface of the band (102) further comprises one or more bumps, protrusions or ridges (114) operable to facilitate positioning of the neck support region (108) and/or a detachable component (110) at the desired location on the neck of an individual. In some embodiments, the one or more bumps, protrusions or ridges (114) are disposed in the neck support region (108).

Further, in some embodiments, the neck support apparatus (100) can have any dimensions in the neck support region (108) operable to restrain, prevent or inhibit neck extension beyond any of the angles recited herein. Alternatively, in other embodiments such as embodiments wherein the neck support apparatus is coupled to body equipment, the neck support apparatus (100) can have dimensions in the neck support region (108) that are not necessarily operable to restrain, prevent or inhibit neck extension beyond any of the angles recited herein.

In some embodiments, the neck support region (108) has a height of at least about 1 inch, where the height is measured in the same direction as the longitudinal axis of the neck (i.e., from the base of the neck toward the head, or parallel to a vector extending perpendicularly out of the plane of the paper in FIG. 1). In some embodiments, the neck support region (108) has a height of at least about 1.5 inches or at least about 1.75 inches. In some embodiments, the neck support region (108) has a height from about 1 inch to about 5 inches, from about 1 inch to about 4 inches, or from about 1 inch to about 3 inches.

In addition, in some embodiments, the neck support region (108) has a thickness of at least about 0.25 inches, where the thickness is measured in the same direction as the radial axis of the neck (i.e., perpendicularly outward from the back or side of the neck, such as the direction labeled "t" in FIG. 1). In some embodiments, the neck support region has a thickness of at least about 0.33 inches or at least about 0.5 inches. In some embodiments, the neck support region (108) has a thickness from about 0.25 inches to about 2 inches, from about 0.33 inches to about 1.5 inches, or from about 0.5 inches to about 1 inch. In some embodiments, the neck support region (108) has a height of at least about 1 inch and a thickness of at least about 0.25 inches. In some embodiments, the neck support region (108) has a height of at least about 1.5 inches and a thickness of at least about 0.33 inches. In some embodiments, the neck support region (108) has a height of at least about 1.75 inches and a thickness of at least about 0.5 inches. In some embodiments, the neck support region (108) has a height from about 1 inch to about 5 inches and a thickness from about 0.25 inches to about 2 inches.

Moreover, the dimensions of the neck support apparatus (100) in the neck support region (108), in some embodiments, include the dimensions of both the band (102) and any detachable component (110) reversibly coupled to the band (102).

For example, in some embodiments, the band (102) has a thickness of about 0.25 inches and a detachable component (110) has a thickness of about 1 inch, for a total thickness of about 1.25 inches. In other embodiments, the dimensions of the neck support region (108) include only the dimensions of the band (102). In some embodiments, for example, it may be desirable for the band (102) itself to be relatively thick, such as when the neck support apparatus (100) does not comprise a detachable component (110) coupled to the band (102). In other embodiments, it may be desirable for the band (102) to be relatively thin, such as when the neck support apparatus (100) does comprise a detachable component (110) coupled to the neck support region (108) of the band (102).

Further, in some embodiments, the ratio of the total thickness of the neck support region (108) to the thickness of the band (102) is at least about 1.5:1. In some embodiments, the ratio is at least about 2:1 or at least about 3:1. In some embodiments, the ratio is at least about 4:1, at least about 5:1, at least about 6:1, at least about 7:1, or at least about 8:1. In some embodiments, the ratio of the total thickness of the neck support region to the thickness of the band is between about 1.5:1 and about 8:1, between about 2:1 and about 6:1, or between about 2:1 and about 5:1. In some embodiments, the ratio is between about 3:1 and about 5:1. In some embodiments, the ratio is about 4:1.

Referring again to the figures, the first end (104) of the band (102) illustrated in FIG. 1 comprises a first fastener (116), and the second end (106) of the band (102) comprises a second fastener (118). The first (116) and second (118) fasteners are operable to attach to an article on the torso or waist of an individual. The first (116) and second (118) fasteners can comprise any fasteners not inconsistent with the objectives of the present invention. In some embodiments, for example, the first (116) and second (118) fasteners comprise clamps or clips. In some embodiments, the first (116) and second (118) fasteners comprise hook and loop fasteners, buttons or snap arrangements. In some embodiments, the first (116) and second (118) fasteners comprise rings or ring fasteners, such as D-rings or D-ring fasteners.

Moreover, in some embodiments, a band described herein further comprises a cross-member, such as the cross-member (120) illustrated in the embodiment of FIG. 1. The cross-member (120) is adapted to couple a section of the band (102) on one side of the neck support region (108) with a section of the band (102) on the opposite side of the neck support region (108). In being operable to couple sections of the band (102) on opposing sides of the neck support region (108), the cross-member (120), in some embodiments, can tighten or loosen the band (102), thereby assisting in maintaining the proper positioning of the neck support region (108) on an individual's neck. In some embodiments, the cross-member (120) couples opposing sides of the band (102) by at least one hook and loop fastening arrangement. Moreover, in some embodiments, the cross-member (120) is operable to rotate 360 degrees relative to the band (102).

The cross-member (120) can be coupled to the band (102) in any manner not inconsistent with the objectives of the present invention. In some embodiments, for instance, the cross-member (120) is coupled to the band (102) by a snap arrangement. A snap arrangement, in some embodiments, can facilitate rotation of the cross-member (120) 360 degrees relative to the band (102). In some embodiments, the cross-member (120) can be coupled to the band (102) by a button arrangement. Further, in some embodiments, the cross-member (120) is reversibly coupled to the band (102). In being reversibly coupled, the cross-member (120) can be detached from the band (102).

Figure 3:
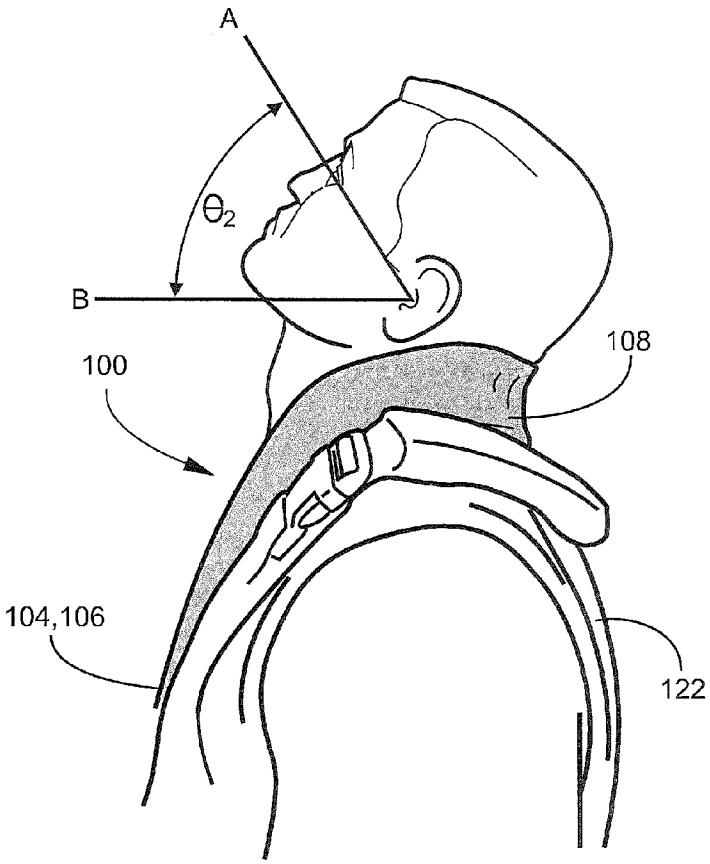
FIG. 3 illustrates a perspective view of the neck support apparatus of FIG. 1 applied to the neck of an individual according to one embodiment described herein.
Figure 2:
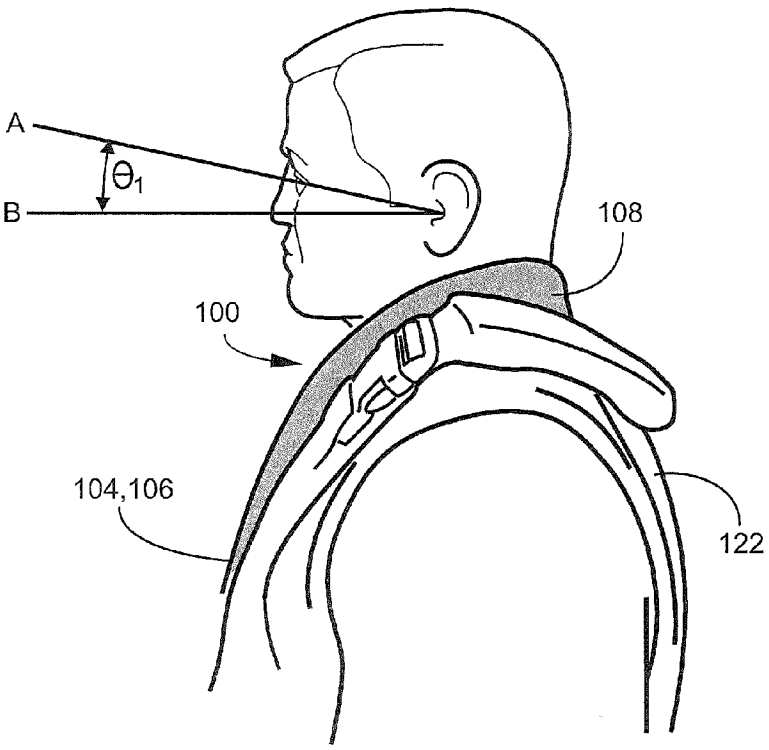
FIG. 2 illustrates a perspective view of the neck support apparatus of FIG. 1 applied to the neck of an individual according to one embodiment described herein.

FIGS. 2 and 3 illustrate perspective views of a neck support apparatus (100) applied to the neck of an individual according to one embodiment described herein. As illustrated in FIGS. 2 and 3, the neck support region (108) of the neck support apparatus (100) has one or more dimensions sufficient to restrain neck extension beyond a desired extension angle or critical angle when the band (102) is placed in tension by coupling the first (104) and second (106) ends to an article (122) on the torso or waist of an individual. The angle is defined by the intersection of a line (A) drawn from the tragus of the ear to the canthus of the eye and a horizontal line (B) of the tragus. The line (A) drawn from the tragus of the ear to the canthus of the eye, in some embodiments, can be referred to as the Ear-Eye Line or EE Line. The intersection of lines (A) and (B) forms an angle $\theta$, where the value of $\theta$ can vary based on the neck extension of the individual wearing the neck support apparatus (100). For example, in FIG. 2 the angle $\theta$ has a value of $\theta_1$ while the neck of the individual is less extended. But the angle $\theta$ increases to a value of $\theta_2$ when the neck of the individual is more extended, as illustrated in FIG. 3.

In some embodiments, the angle (or maximum value of $\theta$) is about 70 degrees. In such embodiments, the neck support region (108) has one or more dimensions sufficient to restrain, prevent, or inhibit neck extension beyond a 70 degree angle when the band (102) is placed in tension by coupling the first (104) and second (106) ends to an article (122) on the torso or waist of an individual. In other embodiments, the angle is about 50 degrees or about 40 degrees. In some embodiments, the angle is about 35 degrees, about 30 degrees or about 25 degrees. In some embodiments, the angle is about 20 degrees or about 15 degrees.

Figure 4:
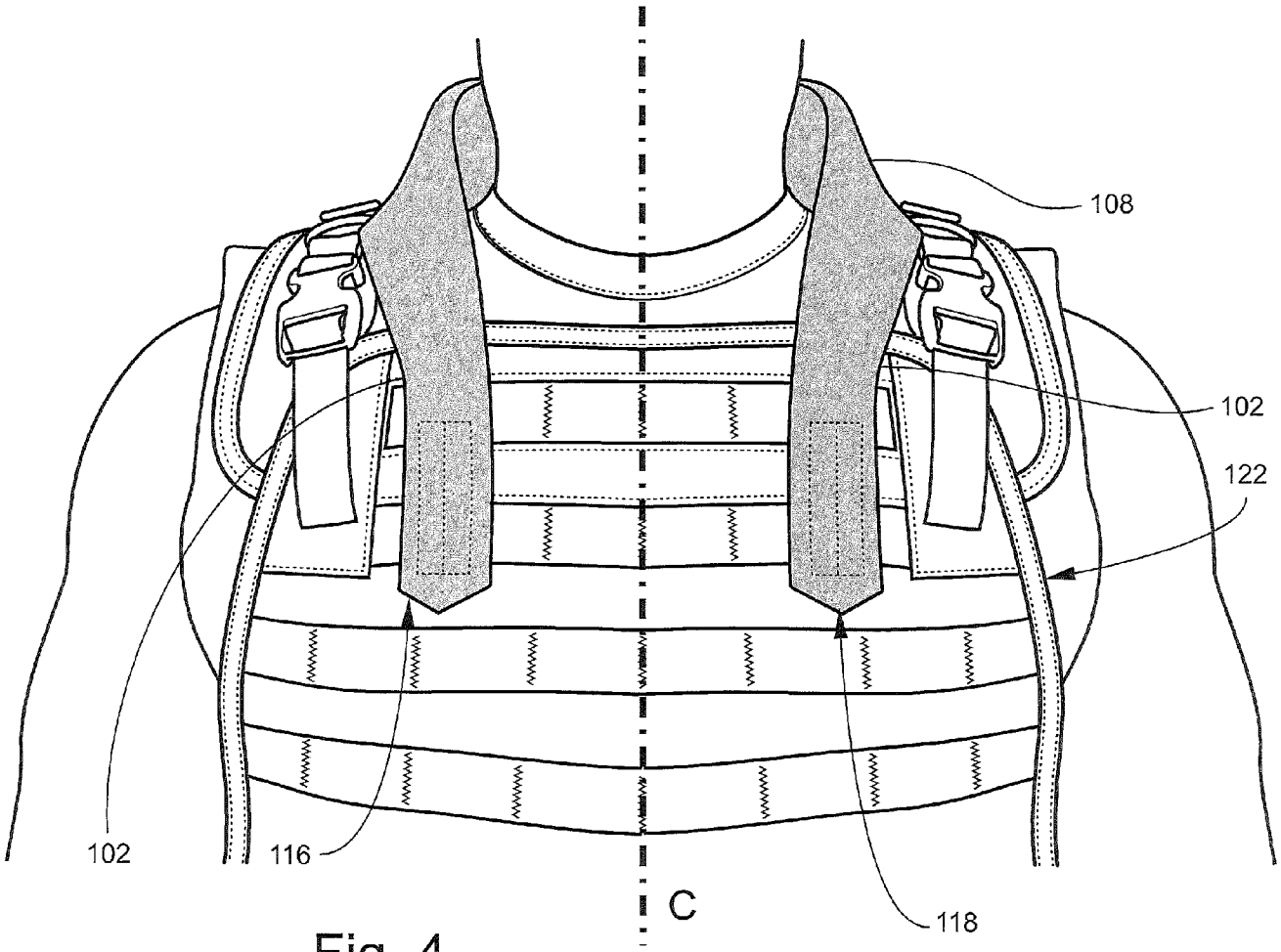
FIG. 4 illustrates a frontal view of a neck support apparatus applied to the neck of an individual according to one embodiment described herein.
Figure 5:
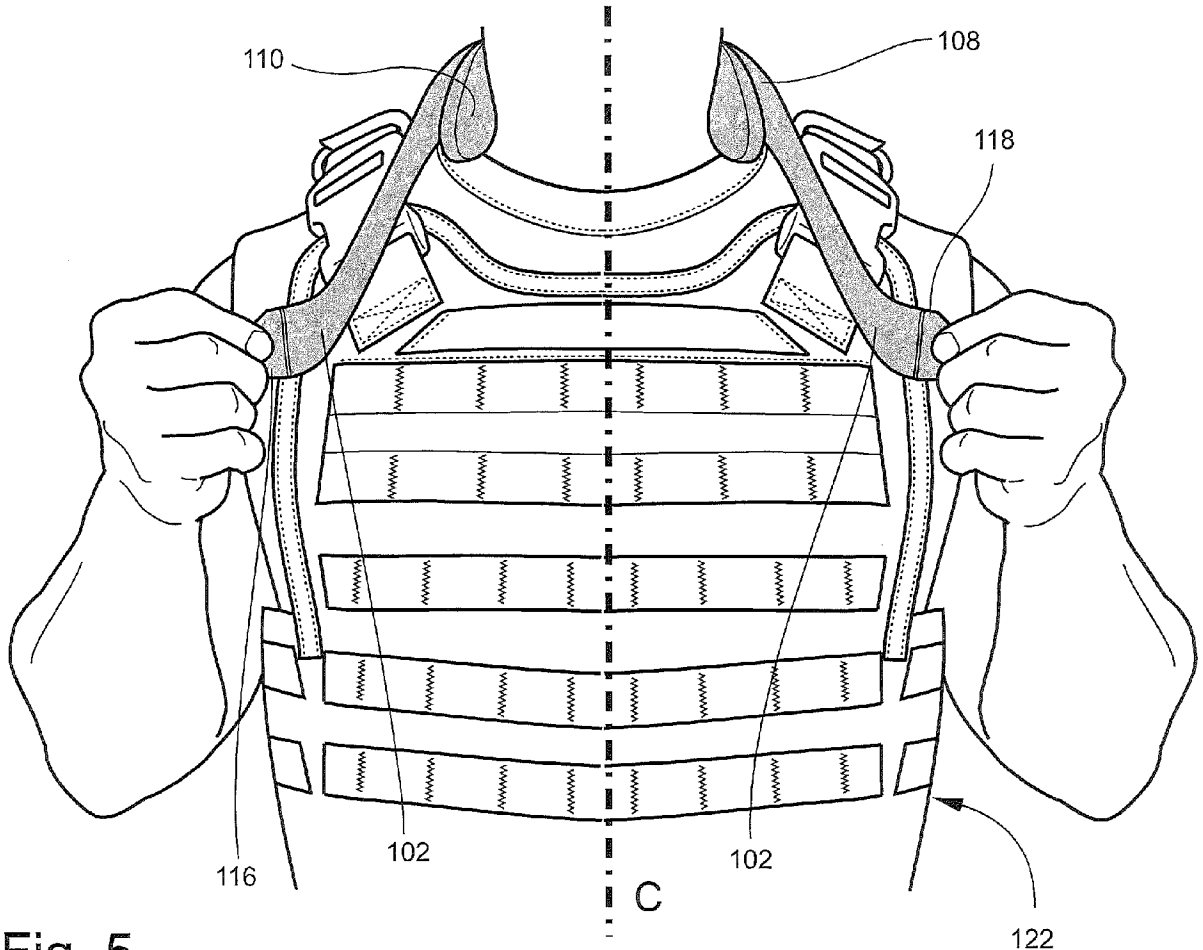
FIG. 5 illustrates a frontal view of a neck support apparatus applied to the neck of an individual according to one embodiment described herein.

FIGS. 4 and 5 illustrate frontal views of a neck support apparatus (100) applied to the neck of an individual according to one embodiment described herein. In the embodiment illustrated in FIGS. 4 and 5, first (116) and second (118) fasteners of band (102) are coupled to an article (122) on the torso of an individual. The coupling of the first (116) and second (118) fasteners to the article (122) provide tension which, in some embodiments, is operable to restrain, prevent, or inhibit neck extension of the individual beyond a desired extension angle or critical angle described herein, including an angle in the sagittal plane (C). Further, in some embodiments, the tension is provided by applying force to the first (104) and second (106) ends and/or the first (116) and second (118) fasteners of the band (102) prior to or while coupling the first (116) and second (118) fasteners to the article (122). Applying force can be carried out in any manner not inconsistent with the objectives of the present invention. In some embodiments, for example, force is applied by pulling down on the first (104) and second (106) ends and/or the first (116) and second (118) fasteners of the band (102) as illustrated in FIG. 5. Moreover, in some embodiments, the amount of tension provided can be varied by altering the amount of force applied to the first (104) and second (106) ends and/or the first (116) and second (118) fasteners prior to or while coupling the fasteners to the article (122).

Figure 6:
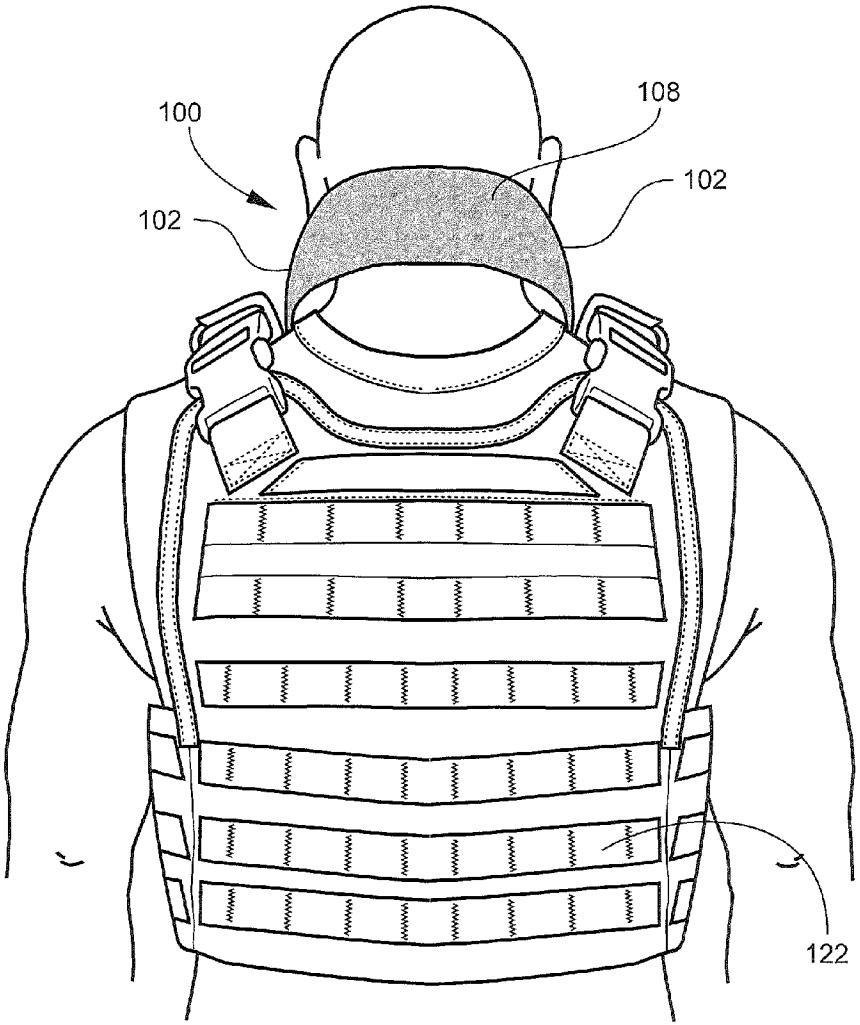
FIG. 6 illustrates a back view of a neck support apparatus applied to the neck of an individual according to one embodiment described herein.

Moreover, as illustrated in FIGS. 4-6, band (102) of neck support apparatus (100), in some embodiments, does not enclose the neck of the individual. In some embodiments, the band (102) partially encircles the neck of the individual. Moreover, in some embodiments, use of a cross-member (120) also does not completely encircle or enclose the neck of the individual. Further, the neck support apparatus (100) does not substantially restrict movement of the arms, thereby permitting use in a wide variety of fields. Commercial laborers, for example, can utilize neck support apparatus described herein while working to achieve neck support and, in some embodiments, relief from hot or cold working conditions. Additionally, athletes can use neck support apparatus described herein during competition. Furthermore, in some embodiments, if a neck support apparatus described herein is pulled by an external force, the apparatus can disengage from the body equipment or article of an individual at the first or second ends of the band.

Any article not inconsistent with the objectives of the present invention may be used. In some embodiments, the article (122) is an article of clothing. An article of clothing, in some embodiments, comprises the waistline of pants or shorts. In some embodiments, an article of clothing comprises a bra or other undergarment. In some embodiments, an article of clothing comprises a bikini top. In other embodiments, an article of clothing comprises a vest. In some embodiments, an article of clothing comprises suspenders.

In other embodiments, the article (122) is body equipment. Any body equipment not inconsistent with the objectives of the present invention may be used. For instance, in some embodiments, body equipment comprises sports equipment or outdoor equipment. Sports or outdoor equipment can include but is not limited to football shoulder pads, football jerseys, football scrimmage/practice vests, baseball or softball jerseys, vests or chest protectors such as those used by umpires and/or catchers, lacrosse shoulder pads, lacrosse jerseys, lacrosse scrimmage/practice vests, golf caddy vests, golf vests, tennis vests, tennis official vests, soccer scrimmage/practice vests, basketball scrimmage/practice vests, motorcycle chest protectors, motorcycle vests, motocross chest protectors, motocross vests, martial arts chest protectors, fencing chest protectors, fencing vests, paintball chest protectors, exercise vests, weight lifting vests, fishing vests, surfing vests, body surfing vests, jockey suits, racing vests, racing suits, racing harnesses, racing crew vests, racing crew suits, racing crew harnesses, racing crew jerseys, climbing harnesses, shoulder harnesses, lifting harnesses, safety harnesses and rescue harnesses.

Figure 7:
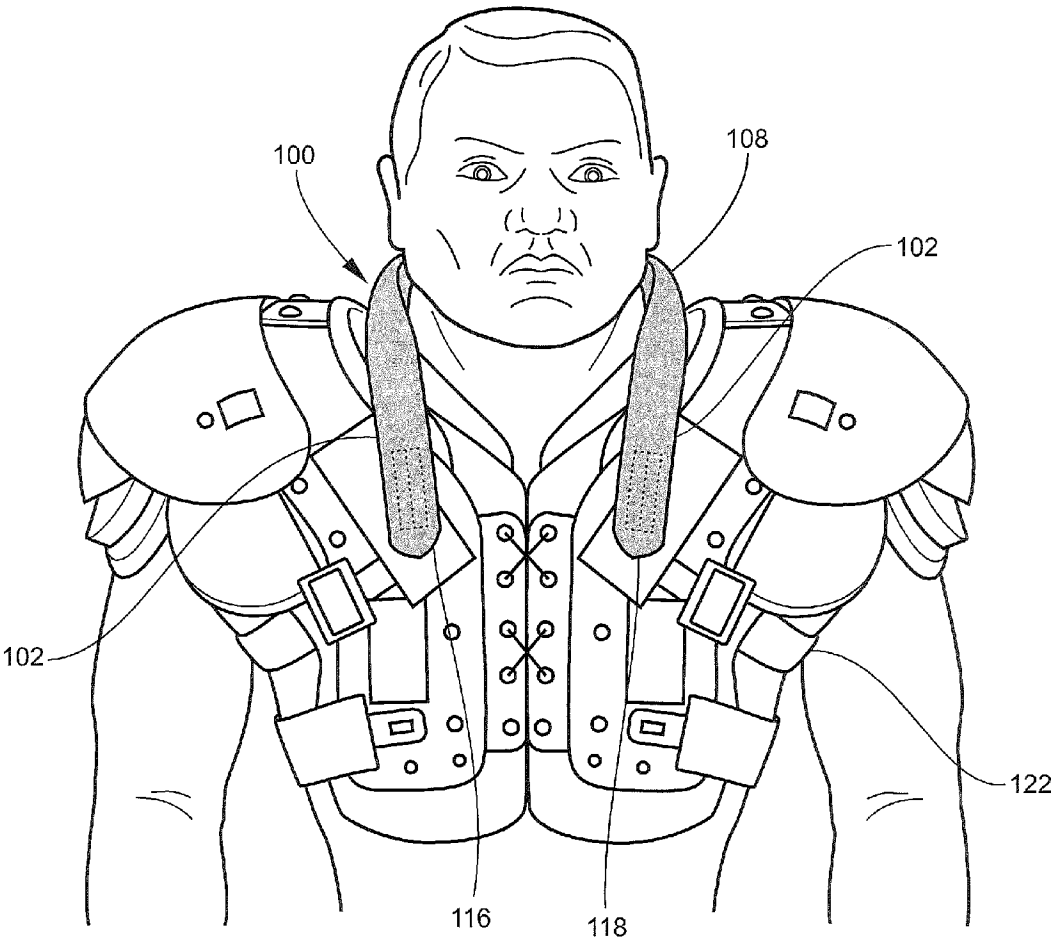
FIG. 7 illustrates a frontal view of a neck support apparatus applied to the neck of an individual according to one embodiment described herein.
Figure 8:
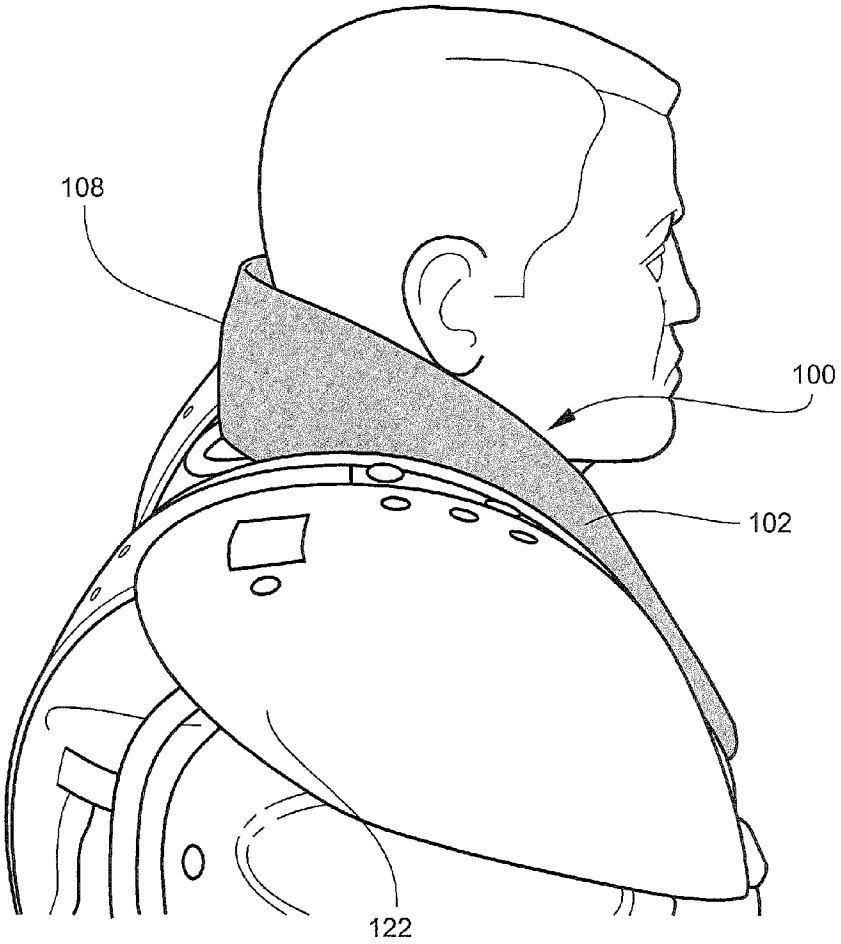
FIG. 8 illustrates a perspective view of a neck support apparatus applied to the neck of an individual according to one embodiment described herein.
Figure 9:
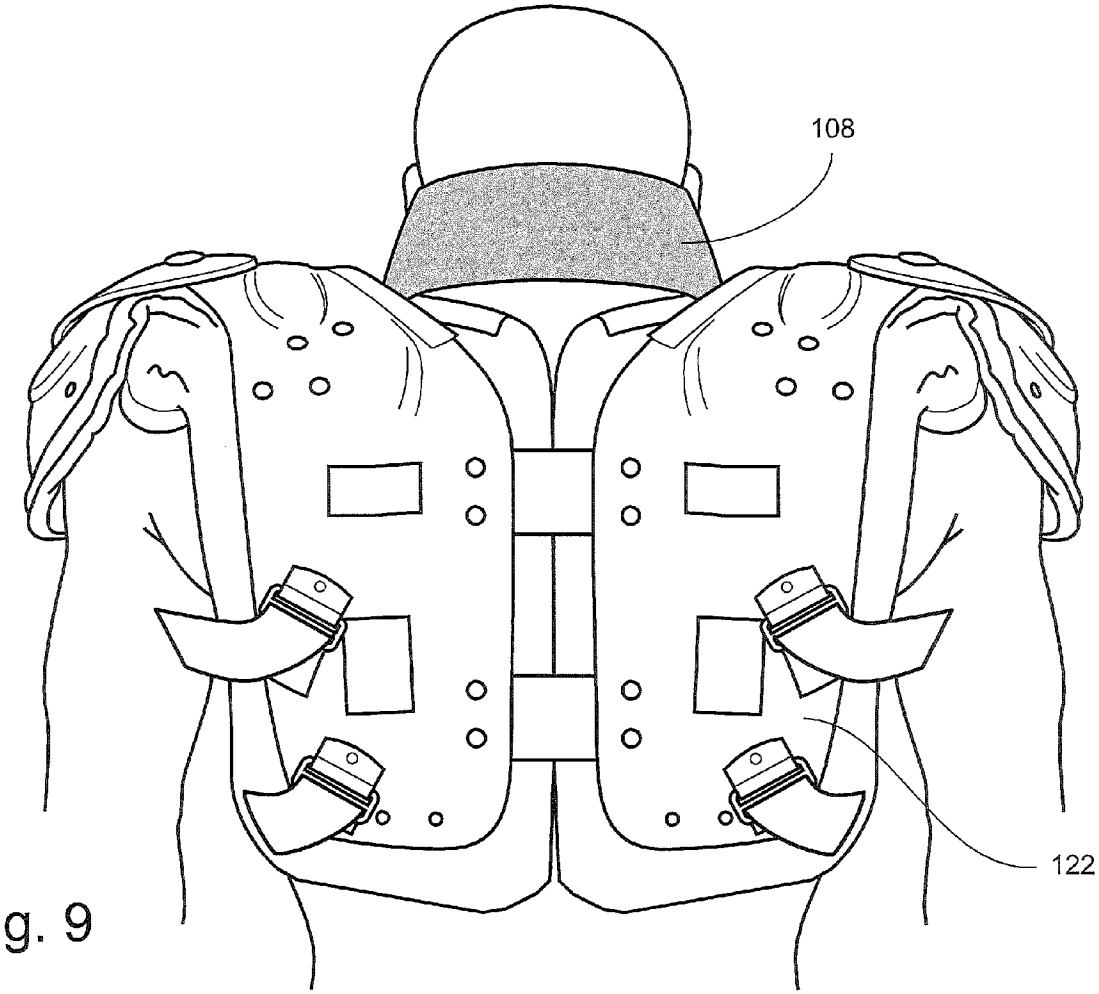
FIG. 9 illustrates a back view of a neck support apparatus applied to the neck of an individual according to one embodiment described herein.

FIGS. 7-9 illustrate an article (122) comprising football equipment. FIG. 7 illustrates a frontal view of a neck support apparatus (100) applied to the neck of an individual according to one embodiment described herein. In a manner similar to the embodiments of FIGS. 2-6, first (116) and second (118) fasteners couple first (104) and second (106) ends of band (102) to the article (122). FIG. 8 illustrates a perspective view of the neck support apparatus (100) of FIG. 7. FIG. 9 illustrates a back view of the neck support apparatus (100) of FIGS. 7 and 8. In some embodiments, neck support region (108) has dimensions suitable for use with both football pads (122) and a football helmet (not shown).

Figure 10:
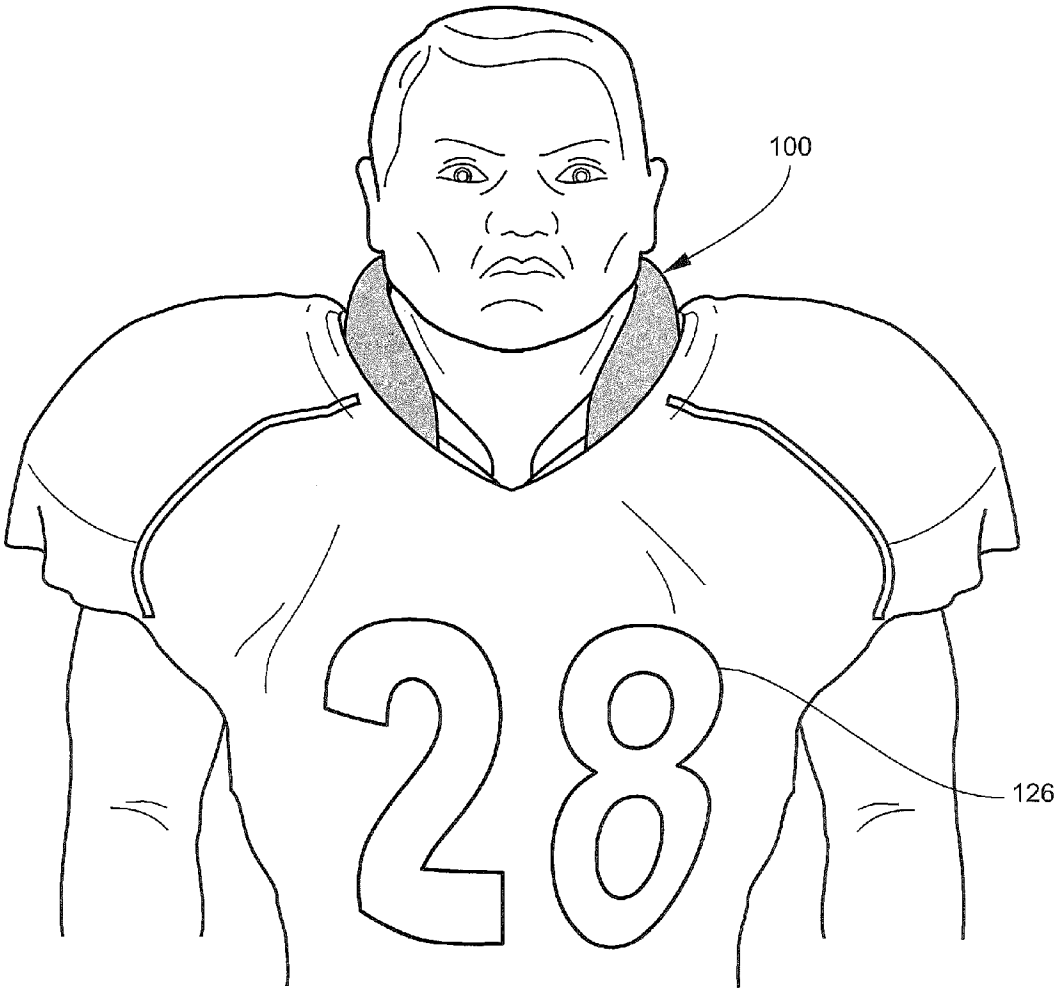
FIG. 10 illustrates a frontal view of a neck support apparatus applied to the neck of an individual according to one embodiment described herein.
Figure 11:
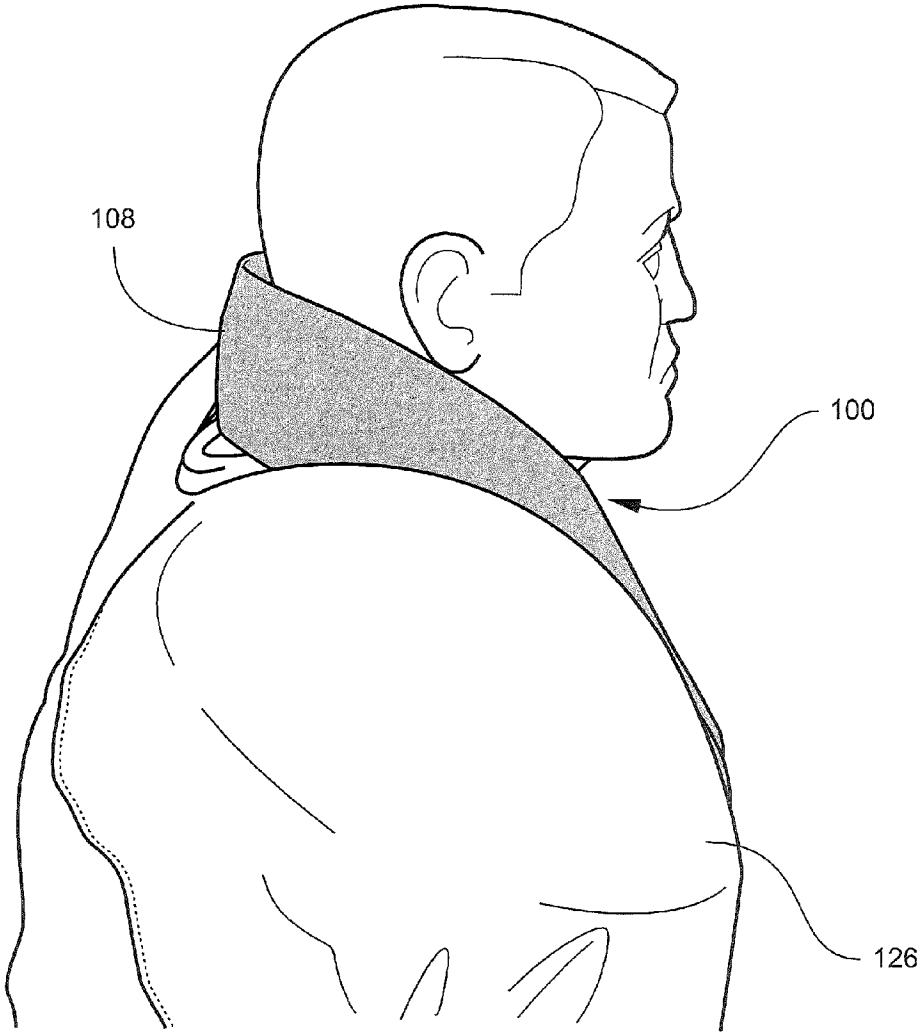
FIG. 11 illustrates a perspective view of a neck support apparatus applied to the neck of an individual according to one embodiment described herein.

Moreover, as illustrated in FIGS. 10 and 11, a neck support apparatus (100) coupled to body equipment (122), in some embodiments, can be disposed and/or secured beneath an article of clothing (126) such as a shirt or jersey. FIG. 10 illustrates a frontal view of a neck support apparatus (100) applied to the neck of an individual according to one embodiment described herein. FIG. 11 illustrates a perspective view of the neck support apparatus (100) of FIG. 10. The placement of a neck support apparatus (100) coupled to body equipment (122) beneath an article of clothing (126), in some embodiments, does not interfere with the activities of the individual wearing the neck support apparatus (100).

In other embodiments, body equipment (122) comprises military, police, or SWAT equipment such as armored vests and/or flak jackets. For example, articles (122) illustrated in FIGS. 2-6 comprise military-style vests. As described hereinabove, the use of neck support apparatus (100) with military, police, or SWAT armored vests and/or flak jackets, in some embodiments, does not interfere with the function of the body equipment or the activities of the wearer. Other non-limiting examples of military, police, or SWAT equipment include additional military, police, or SWAT vests, shirts and bulletproof vests.

Figure 12:
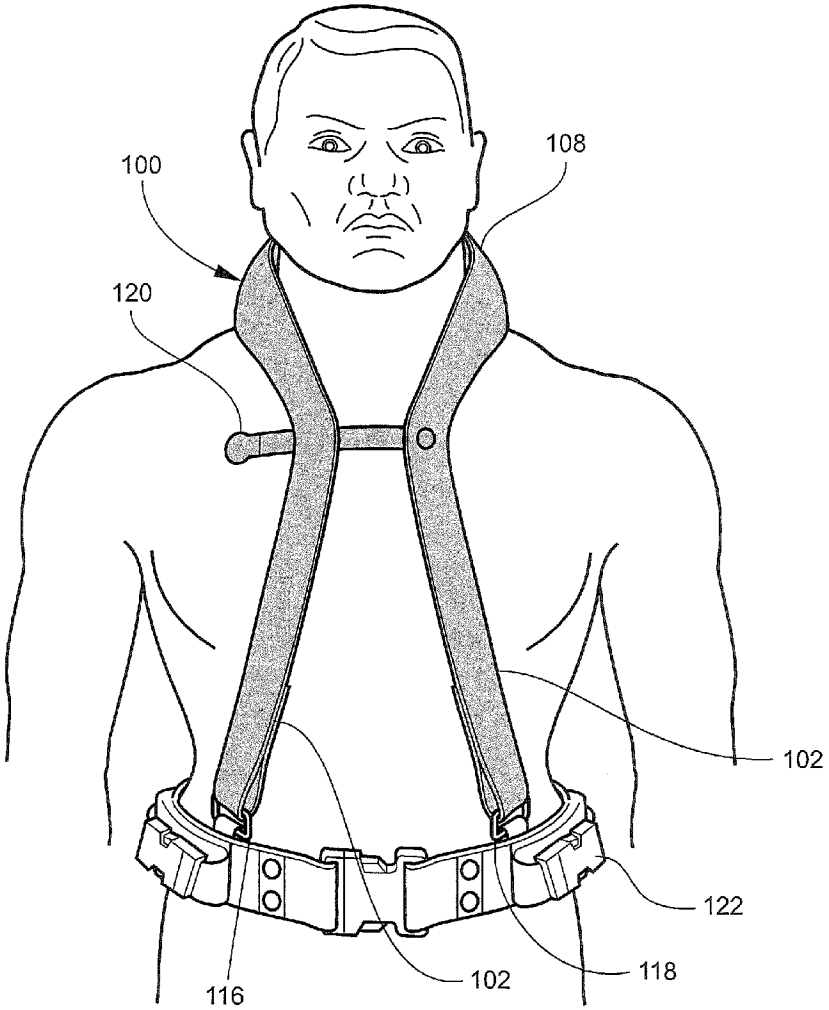
FIG. 12 illustrates a frontal view of a neck support apparatus applied to the neck of an individual according to one embodiment described herein.
Figure 13:
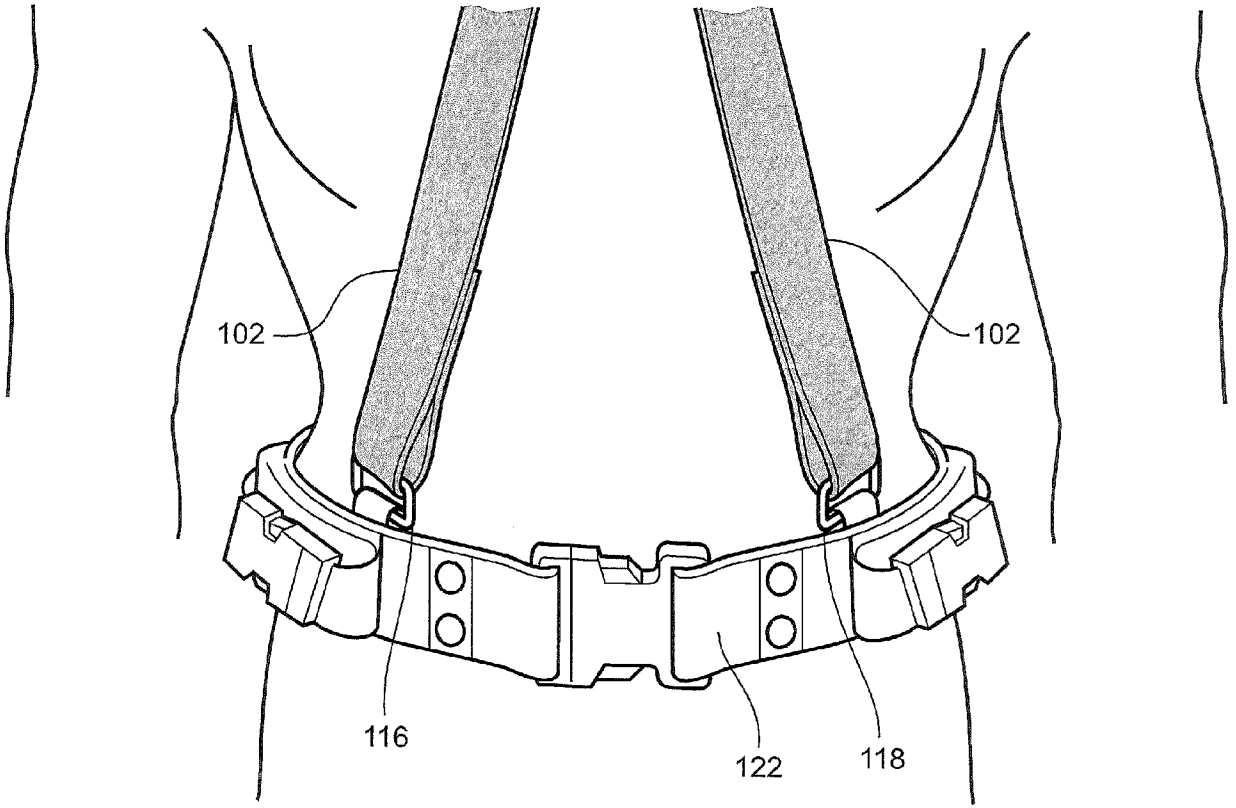
FIG. 13 illustrates a perspective view of a neck support apparatus applied to the neck of an individual according to one embodiment described herein.

In some embodiments, body equipment (122) comprises life preservers, such as life preserver vests. The use of a neck support apparatus (100) described herein, in some embodiments, does not interfere with the operation of the life preserver. In other embodiments, body equipment (122) comprises a load bearing device (LBD). For example, in some embodiments, body equipment (122) comprises a shoulder harness or a belt. Further, a belt, in some embodiments, comprises a military or police belt. FIGS. 12 and 13 illustrate the use of a neck support apparatus (100) with a belt (122) according to one embodiment described herein. In a manner similar to the embodiments of FIGS. 2-6, first (116) and second (118) fasteners couple first (104) and second (106) ends of band (102) to the belt (122). FIG. 12 illustrates a frontal view of a neck support apparatus (100) applied to the neck of an individual. FIG. 13 illustrates a perspective view of the neck support apparatus (100) of FIG. 12. In the embodiment of FIGS. 12 and 13, first (116) and second (118) fasteners comprise D-ring fasteners.

Body equipment (122), in some embodiments, can also include traffic control vests, surgeon operating vests, construction worker vests, road crew vests, work shop vests, tool vests, utility vests, crossing guard vests, safety vests, reflecting vests, cooling vests, cooling jackets, weight-loss vests, and weight-loss jackets.

Turning now to some components of neck support apparatus described herein, neck support apparatus described herein comprise a band. The band of a neck support apparatus described herein can have any length not inconsistent with the objectives of the present invention. In some embodiments, for example, the band has a length sufficient to couple to body equipment or an article on the torso of an individual. In other embodiments, the band has a length operable to couple to body equipment or an article on the waist of an individual. In some embodiments, the length of the band is adjustable, so that the band has a length sufficient to couple to body equipment or an article on either the torso or the waist of an individual. For example, in some embodiments, the first fastener comprises a clamp. The clamp can be coupled to the first end of the band by a loop through which the band is drawn. The band subsequently secures back to itself through at least one hook and loop engagement. A fastener engaging the band by a loop, in some embodiments, facilitates adjustment of the length of the band, thereby providing the proper fit of the band. Further, a fastener engaging the band by a loop, in some embodiments, facilitates adjustment of tension in the band to fit individuals of varying size or to alter a desired extension angle described herein. In addition, in some embodiments, padding can be provided over the loop of the first fastener to prevent irritation resulting from friction between the loop and the body of an individual. In some embodiments, the band has a length between about 36 inches and about 96 inches. In some embodiments, the band has a length between about 30 inches and about 40 inches or between about 48 inches and about 72 inches.

Moreover, the band of a neck support apparatus described herein can be constructed from any desired material. In some embodiments, the band is constructed of an elastomeric material including, but not limited to, rubber. In some embodiments, for example, the band is constructed of neoprene or styrene butadiene rubber (SBR). In some embodiments, the band comprises a laminate material. In some embodiments, the band comprises a neoprene or SBR core covered by a fabric. Suitable fabrics for covering the neoprene core, in some embodiments, comprise polyamides (nylons), polyesters, spandex, fleece, natural fibers, UBL or other hook and loop materials. In some embodiments, the fabric is woven or non-woven. In some embodiments, the band of the neck support apparatus comprises a neoprene or SBR core having a first side covered by UBL or other hook and loop material and the opposing side covered by a fabric comprising a polyamide, polyester, natural fibers, spandex or fleece material.

In some embodiments, exterior surfaces of the band further comprise logos or other advertising and/or information. In one embodiment, for example, surfaces of the band comprise the commercial logo or other information of a company whose workers utilize the neck support apparatus. In another embodiment, surfaces of the band comprise the logo or other information of an athletic franchise whose players utilize the neck support apparatus.

The band can have any desired height not inconsistent with the objectives of the present invention. In some embodiments, the band has a varying height. In one embodiment, for example, the height of the band at the first and/or second ends is less than the height of the band at the neck support region. In some embodiments, the band has a height of at least about 1 inch at the first and/or second end. In other embodiments, the band has a height of at least about 1.5 inches at the first and/or second end.

In some embodiments, the band has a weight of less than about 0.5 pounds. In other embodiments, the band of a neck support apparatus has a weight less than about 0.3 pounds or less than about 0.2 pounds. In some embodiments, the band has a weight greater than about 0.5 pounds.

Neck support apparatus described herein, in some embodiments, comprise a tissue heating or cooling material. Any tissue heating or cooling material not inconsistent with the objectives of the present invention may be used. In some embodiments, a tissue heating or cooling material comprises a gel including, but not limited to, a hydrogel. In other embodiments, a tissue heating or cooling material comprises an aqueous solution having an appropriate solute solubilized or dispersed therein. In some embodiments, a tissue heating or cooling material comprises a solid state material. In some embodiments, a tissue heating or cooling material is encapsulated in a container. Containers suitable for encapsulating tissue heating or cooling materials are well known to one of skill in the art. In some embodiments, containers for tissue heating or cooling materials comprise polymeric materials such as polyolefins, including polyethylene and polypropylene.

In some embodiments, tissue heating or cooling materials are disposed in a linear array of individual compartments or containers. In other embodiments, tissue heating or cooling materials are disposed in a two-dimensional array of individual compartments or containers. In one embodiment, at least one of the individual compartments of a two-dimensional array of heating or cooling packages can serve as a ridge or nub for facilitating the desired position of the neck support apparatus on the neck of an individual. Moreover, in some embodiments, containers or compartments for tissue heating or cooling materials have a preformed shape substantially following the contours or curvature of the neck. In other embodiments, containers or compartments for tissue heating or cooling are sufficiently flexible to conform to the contours or curvature of the neck.

In some embodiments, a tissue heating or cooling material has a weight of less than about 0.5 pounds. In other embodiments, a tissue heating or cooling material has a weight less than about 0.3 pounds or less than about 0.2 pounds. In some embodiments, a tissue heating or cooling material has a weight greater than about 0.5 pounds.

II. Methods of Supporting an Individual's Neck

In another aspect, methods of supporting an individual's neck are described herein. In some embodiments, a method of supporting an individual's neck comprises providing a band comprising a first end, a second end and a neck support region positioned between the first end and the second end; positioning the neck support region adjacent to the neck of the individual; and placing the band in tension by coupling the first end and the second end to an article on the torso or waist of the individual, wherein the neck support region has a thickness sufficient to restrain neck extension beyond a 70 degree angle defined by the intersection of a line drawn from the tragus of the ear to the canthus of the eye and a horizontal line of the tragus. In some embodiments, the method further comprises altering the angle by adjusting the tension of the band. For example, in some embodiments, the angle is increased by reducing the tension of the band. Alternatively, in other embodiments, the angle is decreased by increasing the tension of the band.

In some embodiments, a method of supporting an individual's neck comprises providing a primary band comprising a first end, a second end and a neck support region positioned between the first end and the second end; positioning the neck support region adjacent to the neck of the individual; and placing the band in tension by coupling the first end and the second end to body equipment on the torso or waist of the individual.

Turning now to steps of methods, methods of supporting an individual's neck described herein comprise providing a band comprising a first end, a second end and a neck support region positioned between the first end and the second end. Any band not inconsistent with the objectives of the present invention may be used. In some embodiments, the band comprises any band described hereinabove in Section I, including a band having any of the features described in Section I. For example, in some embodiments, the neck support region of a band suitable for use in methods described herein has a thickness sufficient to restrain, prevent, or inhibit neck extension beyond a 70 degree angle. Alternatively, in other embodiments wherein the band is coupled to body equipment, the neck support region of a band suitable for use in methods described herein does not necessarily have one or more dimensions sufficient to restrain, prevent, or inhibit neck extension beyond a particular angle.

Methods of supporting an individual's neck described herein also comprise positioning the neck support region of a band adjacent to the neck of an individual. Positioning the neck support region adjacent to the neck of the individual can be carried out in any manner not inconsistent with the objectives of the present invention. In some embodiments, positioning is carried out in a manner described hereinabove in Section I. For example, in some embodiments, the band does not enclose the neck of the individual. In some embodiments, the band partially encircles the neck of the individual.

In some embodiments, methods of supporting an individual's neck described herein further comprise altering an angle by adjusting the tension of a band. Altering the angle by adjusting the tension of the band can be carried out in any manner not inconsistent with the objectives of the present invention. In some embodiments, the tension is adjusted in a manner described hereinabove in Section I.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

That which is claimed is:

1. A neck support system comprising:

body equipment adapted to be placed on the torso of an individual; and a neck support apparatus comprising:

a band comprising a first end, a second end, and a neck support region positioned between the first end and the second end, the first end comprising a first fastener and the second end comprising a second fastener, wherein the neck support region has a thickness sufficient to restrain neck extension beyond a 70 degree angle when the band is placed in tension by coupling the first and second ends to the body equipment, the angle defined by the intersection of a line drawn from the tragus of the ear to the canthus of the eye and a horizontal line of the tragus;

wherein a ratio of a total thickness of the neck support region to a thickness of the band is at least 1.5:1;

wherein the neck support region has a thickness of at least 0.25 inches; and wherein the neck support region has a height of at least 1 inch.

2. The neck support system of claim 1, wherein the neck support region of the neck support apparatus has a thickness sufficient to restrain neck extension beyond a 35 degree angle.

3. The neck support system of claim 1, wherein the band partially encircles the neck of the individual.

4. The neck support system of claim 1, wherein the body equipment comprises football shoulder pads.

5. The neck support apparatus of claim 1, wherein the body equipment comprises an armored vest or flak jacket.

6. The neck support apparatus of claim 1, wherein the neck support region has a thickness from about 0.25 inches to about 2 inches.

7. The neck support apparatus of claim 1, wherein the first and second fasteners comprise clamps or clips.

8. The neck support apparatus of claim 1, wherein the first and second fasteners comprise hook and loop fasteners, buttons, or snap arrangements.

9. The neck support apparatus of claim 1, wherein the first and second fasteners comprise D-rings or D-ring fasteners.

10. A method of supporting an individual's neck comprising:

providing body equipment adapted to be positioned on a torso of the individual;

positioning the body equipment on the torso of the individual;

providing a band comprising a first end, a second end, and a neck support region positioned between the first end and the second end; and positioning the neck support region adjacent to the neck of the individual;

placing the band in tension by coupling the first end and the second end to the body equipment, wherein the neck support region has a thickness sufficient to restrain neck extension beyond a 70 degree angle defined by the intersection of a line drawn from the tragus of the ear to the canthus of the eye and a horizontal line of the tragus;

wherein a ratio of a total thickness of the neck support region to a thickness of the band is at least 1.5:1;

wherein the neck support region has a thickness of at least 0.25 inches; and wherein the neck support region has a height of at least 1 inch.

11. The method of claim 10, wherein the neck support region of the band has a thickness sufficient to restrain neck extension beyond a 35 degree angle.

12. The method of claim 10, wherein the band partially encircles the neck of the individual.

13. The method of claim 10, wherein the body equipment comprises football shoulder pads.

14. The method of claim 10, wherein the body equipment comprises an armored vest or flak jacket.

15. The method of claim 10, wherein the neck support region has a thickness from about 0.25 inches to about 2 inches.

16. The method of claim 10, wherein the first end of the band comprises a first fastener and the second end of the band comprises a second fastener.

17. The method of claim 16, wherein the first and second fasteners comprise clamps or clips.

18. The method of claim 16, wherein the first and second fasteners comprise hook and loop fasteners, buttons, or snap arrangements.

19. The method of claim 16, wherein the first and second fasteners comprise D-rings or D-ring fasteners.

* * * * *